United States Patent [19]

Foster

[11] Patent Number: 4,523,525

[45] Date of Patent: Jun. 18, 1985

[54] WATER SKIING TOW SYSTEM

[75] Inventor: Richard L. Foster, Albuquerque, N. Mex.

[73] Assignee: C & I Joint Venture, Albuquerque, N. Mex.

[21] Appl. No.: 325,858

[22] Filed: Nov. 30, 1981

[51] Int. Cl.[3] ..... B61B 7/04; B61B 11/00; E01B 25/14

[52] U.S. Cl. ..... 104/173 ST; 104/117; 104/180; 105/148

[58] Field of Search ..... 104/117, 172 R, 172 S, 104/173 R, 173 ST, 180; 105/148

[56] References Cited

U.S. PATENT DOCUMENTS

| | | | |
|---|---|---|---|
| 374,866 | 12/1887 | Carr | 104/117 X |
| 485,495 | 11/1892 | Fralinger | 104/180 X |
| 900,749 | 10/1908 | Leonard | 104/180 |
| 903,208 | 11/1908 | Leonard | 104/180 |
| 1,068,074 | 7/1913 | Petersen | 104/180 X |
| 3,052,470 | 9/1962 | Pomagalski | 104/173 R X |
| 3,190,646 | 6/1965 | Forsman | 104/173 ST X |
| 3,376,829 | 4/1968 | Hancock | 104/173 R |
| 3,743,278 | 7/1973 | Rixen | 104/173 R X |
| 3,838,647 | 10/1974 | Rixen | 104/172 R X |

*Primary Examiner*—Robert B. Reeves
*Assistant Examiner*—Howard Beltran
*Attorney, Agent, or Firm*—E. C. Walterscheid

[57] ABSTRACT

The invention is directed to a boatless water skiing tow system and a unique traction apparatus for use therein. The traction apparatus comprises a plurality of cable loops connected end to end to form an endless sequence giving the semblance of a dual cable traction device without the disadvantages of such a traction device. Apparatus is provided for equalizing the action of forces applied to the upper and lower arms of the various loops.

9 Claims, 12 Drawing Figures

WATER SKIING TOW SYSTEM

BACKGROUND OF THE INVENTION

The invention described herein relates to a water skiing tow system and more particularly to specific apparatus useful in such a system.

Various systems for towing water skiers are known in the art. Generally, they involve the use of an endless cable means driven continuously at a usually constant speed of, e.g., 25 miles per hour, above a body of water or a waterway to define a closed ski path over which a skier can move within certain reasonably broad constraints. It has been found quite advantageous in such systems for the endless cable to consist of two cables running substantially parallel and having rigid spacers between them at periodic intervals.

Unfortunately, a significant problem with the use of such two-cable systems is the difficulty in maintaining equal forces on both cables during operation of the system. In attempts to assure that the forces are evenly distributed, past practices have included the use of right-lay (twist) cable paired with left-lay cable, massive spring systems, differential drives on driven pulleys or rollers, and tedious adjustment of relative cable lengths.

Accordingly, it is a general object of the present invention to provide a water skiing tow system in which the aforementioned problem and difficulties may be avoided.

A specific object of the present invention is to provide improved traction apparatus for use in a water skiing tow system.

Another specific object of the present invention is to provide an improved water skiing tow system which has the advantages of dual cable traction apparatus but which avoids or minimizes the disadvantages inherent in the use of dual cable traction.

Another specific object of the present invention is to provide an improved water skiing tow system in which the lay of any traction cable is immaterial.

Another specific object of the present invention is to provide an improved water skiing tow system in which the forces on the various elements of the traction cables are equalized.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects and in accordance with the purpose of the present invention, as embodied and broadly described herein, in one embodiment the apparatus of the invention is directed to traction apparatus useful in a system for towing water skiers which comprises (a) a plurality of cables, each of which is formed into a single, open ended loop, and (b) a plurality of apparatus for connecting the cable loops end to end to produce an endless or closed sequence of the loops.

In a further aspect of the present invention, in accordance with its objects and purposes, another embodiment, which is directed to a novel water skiing tow system, comprises the following combination of elements: (a) sets of drive and idler pulley pairs, (b) apparatus for supporting the sets of drive and idler pulley pairs at a desired elevation and in a desired spaced relationship corresponding generally to an intended towing path, (c) traction apparatus comprising a plurality of open ended cable loops and a plurality of apparatus for connecting the cable loops end to end to produce an endless or closed sequence in which the arms of each loop are substantially parallel and trained over the pulleys of each pulley pair, (d) apparatus for driving the traction apparatus at a predetermined speed, (e) a plurality of tow lines, and (f) apparatus for coupling and releasing the tow lines to and from the traction apparatus.

The invention is not limited to apparatus but is also directed to a method of forming a traction apparatus useful in a water skiing tow system which comprises: (a) forming a plurality of open ended cable loops in which the ends of the cable forming an individual loop are held in fixed spaced parallel relationship, and (b) connecting the loops end to end to form an endless sequence in which the loops when taut are disposed in substantially the same plane and the upper and lower arms of each loop follow common paths substantially parallel to each other.

The various embodiments of the invention as claimed are advantageous in that they equalize forces on the cable traction apparatus in a manner superior to that taught in various prior art devices or systems or permit force equalization to be achieved in a manner superior to that of prior art devices or systems.

BRIEF DESCRIPTION OF THE DRAWINGS

The accompanying drawings, which are incorporated in and form a part of the specification, illustrate a preferred embodiment of the present invention and, together with the description, serve to explain the principles of the invention. In the drawings.

DETAILED DESCRIPTION OF THE INVENTION

Figure 1:
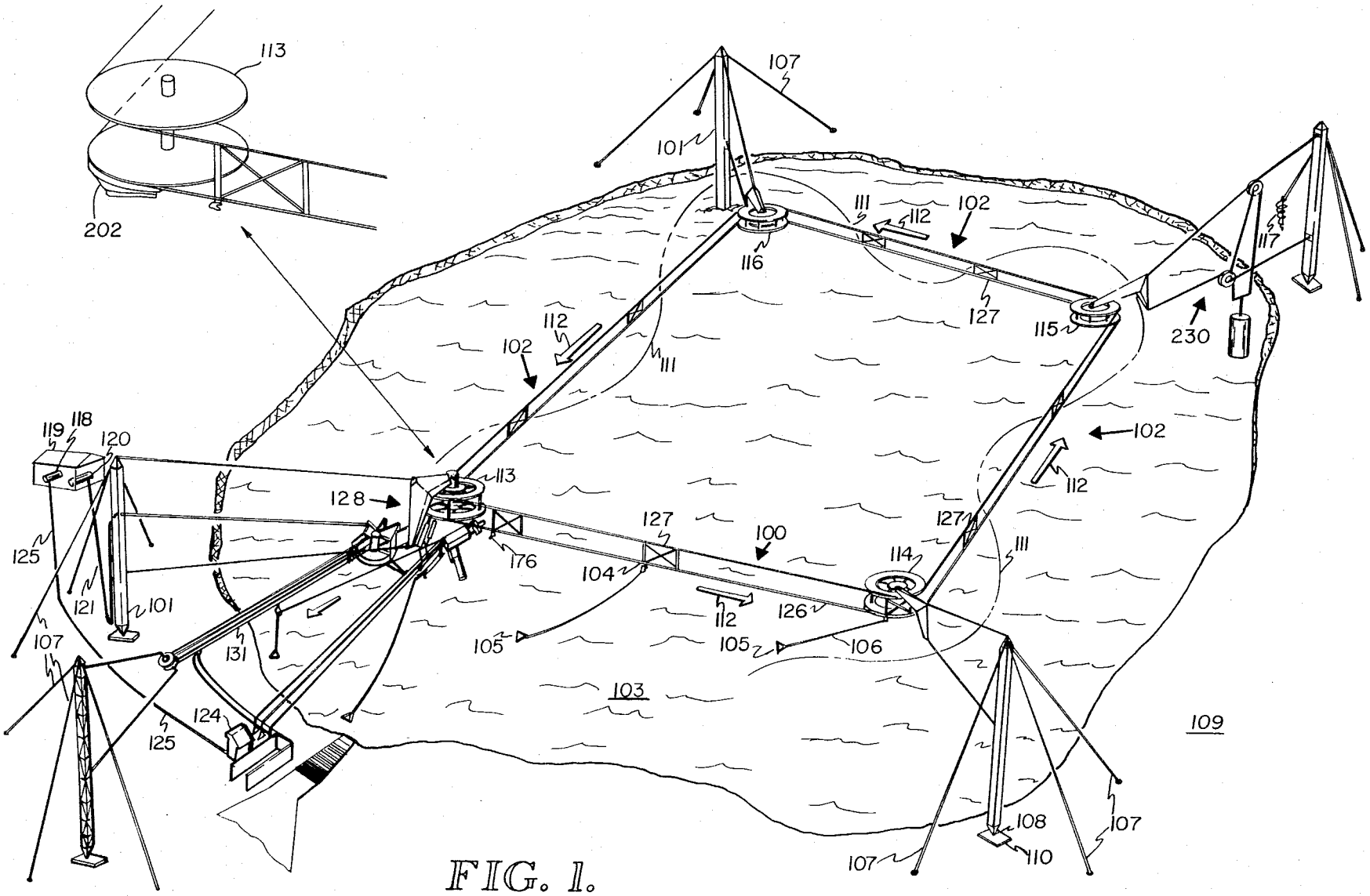
FIG. 1 is a schematic view in perspective showing the general relationship of the various components of the water skiing tow system of the invention with one of many different possible ski paths shown by dashed lines.

Various features of the preferred embodiments of the invention are set forth in FIGS. 1-12. The water skiing tow system of the invention is shown generally from above in FIG. 1. Traction apparatus 100 mounted on a plurality of towers or masts 101 describes a closed circuit 102 above a body of water 103. A plurality of attachment points 104 are provided on traction apparatus 100 whereby water skiers 105 are pulled by individual towing apparatus 106 around the course circuit 102.

The shape of course circuit 102 may vary considerably depending on the number of support towers 101 and their orientation with respect to each other. Towers 101 are typically arranged to form a polygon, as viewed from above, with a four sided shape being the simplest. As few as three towers may be used but this is not particularly preferred in that it places rather stringent turning requirements on the skier which may be difficult to master for the beginning or intermediate skier. It is readily apparent that more than four towers may be used to produce the desired course configuration.

Towers 101 are preferably simple compression members with guy wires 107 attached as necessary to resist overturning moments produced by the forces resulting from the movement of traction apparatus 100 and of skiers 105 being towed thereby. The guy wires 107 may be anchored to the ground in any conventional manner as, for example, through the use of a screw anchor 117. While towers 101 may, if desired, be mounted on fixed foundations, in the preferred embodiment the base 108 of each tower merely sits atop the earth, either on the beach 109 or under the water 103. Spade-like protrusions 110 fixed to the underside of each base 108 resist any side-to-side thrust generated during operation of the system. The absence of permanent foundations permits towers to be quickly and simply installed at desired locations and readily removed with minimal environmental impact.

The height of the individual towers 101 and the length of the individual towing apparatus 106 are selected to permit a wide variety of skiing tracks 111 to be pursued by each skier 105. Since typically the individual towing apparatus 106 are standard water skiing tow ropes, the type of ski track 111 permitted is usually determined by the height of the towers 101. Near optimum tracks 111 can be achieved if the height of towers 101 is such as to maintain traction apparatus 100 a nominal 35 feet above water 103. In normal operation, traction apparatus 100 moves continuously in a counterclockwise rotation as shown by arrows 112. There is nothing which precludes it from being operated clockwise, however, most persons are righthanded and therefore feel more comfortable in commencing the tow in a direction which initially takes them to the right of their starting position. For reasons which are known in the art, it is highly preferable that at pickup a skier be oriented at substantially a right angle to the direction of movement of traction apparatus 100.

In the embodiment shown in FIG. 1, traction apparatus 100 moves around pulley pairs 113, 114, 115, and 116 in that order, with pulley pair 113 being the drive pulleys while the others serve merely as idler pairs. Idler pairs 114, 115, and 116 are preferably so-called "flying" pulleys. The "flying" arrangement permits flexible support for the pulleys while permitting them to move both vertically and horizontally to some extent. In the embodiment of FIG. 1, idler pulley pair 115 has tensioning apparatus 230 attached thereto to maintain a desired tension on traction apparatus 100. Details of a "flying" pulley arrangement as used in a water skiing tow system are shown in U.S. Pat. No. 3,838,647 issued Oct. 1, 1974 to Bruno Rixen which is hereby incorporated by reference for all that it teaches.

Motive power for traction apparatus 100 is provided through drive pair 113 by power source 118. Power source 118 may typically be a gasoline or diesel engine or an electric motor, with an electric motor preferred. Although it may be placed on or immediately adjacent to the tower supporting drive pulley pair 113, a more desirable location is in a cottage 119 somewhat removed from the loading and unloading area. Cottage 119 isolates power source 118, thereby providing security, safety, and sound insulation and assuring a quiet and pleasant atmosphere at the loading and unloading area.

Power source 118 preferably drives a variable displacement pump 120 which is connected by hydraulic lines 121 to a hydraulic motor installed along with a reduction unit (neither of which are shown in FIG. 1) on drive pulley pair 113. By console 124 connected by remote control circuit 125 to power source 118 and pump 120, the speed of drive pulley pair 113 and hence of traction apparatus 100 is controlled. The tow system of the invention may be operated at speeds of up to 40 miles per hour which may be varied by means of console 124 to suit the level of expertize of the skiers 105 being towed. Typical operating speeds are in the range of 25-30 miles per hour.

Attachment points 104 are spaced equidistant from each other, and in the preferred embodiment ten attachment points are allocated to each mile length of traction apparatus 100. Any higher allocation is undesirable for safety reasons and because of difficulties in loading and unloading skiers. If desire, skiers can be paired at each attachment point.

The tow system of the invention is predicated on the use of a cable drive unit as traction apparatus 100. A cable drive system of any sort requires structure for attaching the load to the drive cable. Where the load can be attached to the cable permanently, a single cable works well. However, if it is desired to alternately attach and release the load, orientation of the attachment point to the cable becomes very difficult in that a running cable tends to rotate about its axis as it moves.

In one aspect of the present invention, this problem is overcome by arranging traction apparatus 100 to comprise a plurality of cable loops 126 connected to one another by means of a plurality of cable X panel assemblies 127. Loops 126 when interconnected by cable X panels 127 form a closed or endless ladder chain which can then be made to run about, i.e., be trained on, paired pulleys 113, 114, 115, and 116. In appearance, the interconnected cable loops resemble an apparently endless cable pair, with one cable running above the other. This appearance is deceiving, for they are in reality independent units, each capable of seeking and achieving the configuration necessary to maintain the desired orientation of attachment points 104. This ability to seek and automatically achieve the correct orientation of attachment points 104 is a novel feature of the invention.

The X panel assemblies 127 serve multiple purposes. Besides serving as the apparatus for interconnecting cable loops 126, they also provide a apparatus for equalizing the load between the two pulleys of each pulley pair 113, 114, 115, and 116. Another important function they serve is as the units to which attachment points 104 are integrated.

Automatic handling of tow ropes 106 is achieved by loading and unloading mechanism 128. Mechanism 128 determines whether a skier 105 is to be unloaded after having made one pass around circuit 102 or is to be allowed to continue the tow for one or more additional passes. If the skier is unloaded, mechanism 128 catches the individual tow rope 106, transfers it to a magazine, takes the tow rope handle to the skier loading area, and readies the tow rope 106 for recycling as needed to load other skiers. Alternatively, transfer of tow ropes 106 in the loading and unloading area may be accomplished manually.

Figure 2:
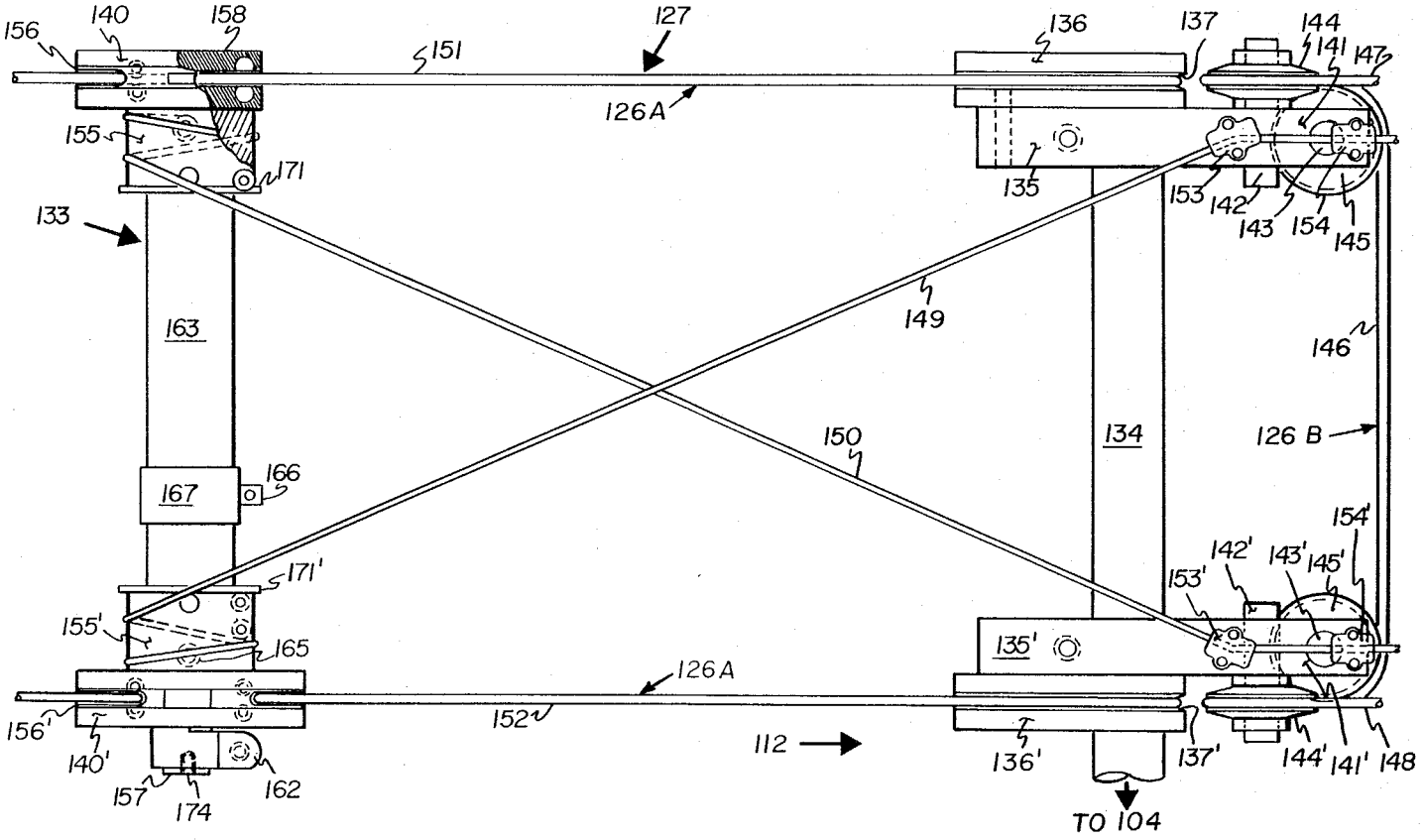
FIG. 2 is a side plan view of a cable X panel assembly preferred for use in the water skiing tow system of the invention.
Figure 3:
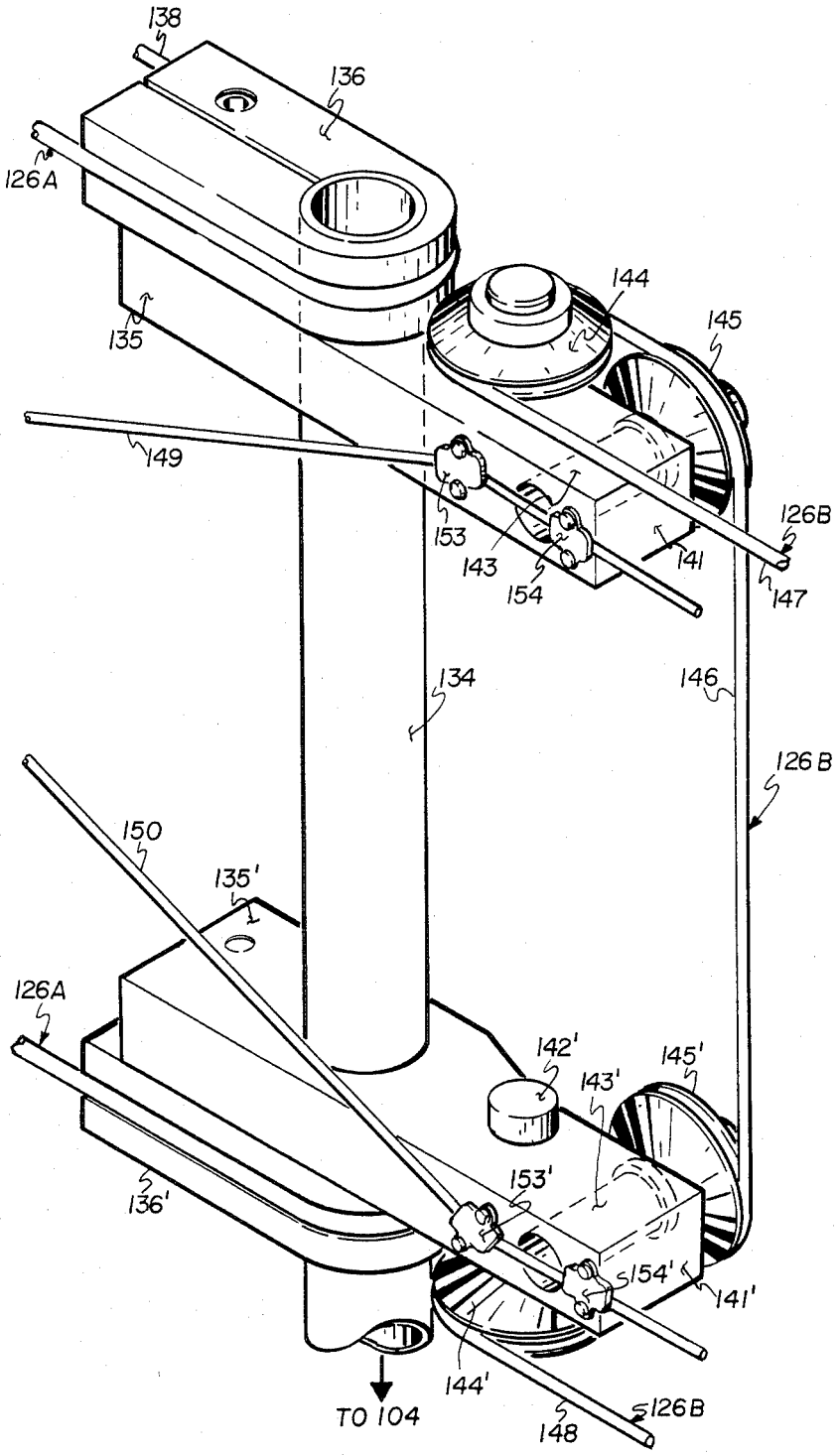
FIG. 3 is an isometric view of the components associated with tubular upright member 134 of the X panel assembly of FIG. 2 which form an equalizer unit for a cable loop engaged by the X panel assembly.

The cable X panel assemblies 127 will now be described in greater detail. As shown in FIGS. 2 and 3, an X panel assembly 127 has two tubular upright members 133, 134 which serve as spacer elements to ensure that the top and bottom arms of cable loops 126 properly engage the drive and idler pulley pairs 113, 114, 115, and 116. Moreover, as can be seen, upright member 134 takes the compressive load generated by the vertical section or base 146 of cable loop 126B.

Upright member 134 has two mounting blocks 135, 135' fitted to it. The only purpose of blocks 134, 135' is to serve as mounting points for other parts of X panel assembly 127. Thus, mounted immediately outward of blocks 135, 135' are cable clamping blocks 136, 136' which are the structure by which cable loop 126A is formed. Cable 126A is seated in grooves 137, 137' in blocks 136, 136' and its ends 138, 138' pass under clamps (not shown) which hold it rigidly attached to blocks 136, 136'.

Mounting blocks 135, 135' have an elongated extension 141, 141' in which are mounted bearing pins 142, 142', 143, 143' for cable sheaves 144, 144' and 145, 145', respectively, for cable loop 126B. In combination, sheaves 144, 144', 145, 145' form an equalizer unit which serves to maintain an equal length of cable in the top arm 147 and the bottom arm 148 of cable loop 126B.

As the system operates, the cables are subjected to various forces which tend to cause the top or bottom portions of the cable loops 126 to lengthen or shorten. These forces include but are not limited to variations in drive and idler pulley diameters, cable loading, cable sag between pulley pairs, and uneven stretching of cables. As shown by the example of cable loop 126B in FIGS. 2 and 3, these various dynamic, ever-changing forces are equalized by the movement of cable 126B around sheaves 144, 144', 145, 145'. If top arm 147 of cable loop 126B tends to lengthen, bottom arm 148 tends to get more taut, causing whatever length difference there may be to be fed from top to bottom, i.e., around sheave 144 to sheave 145, down to sheave 145' and back around sheave 144'. Conversely, if bottom arm 148 tends to go more taut the equalizing process works in the reverse direction, i.e., cable is fed back around sheaves 144' and 145', up to sheave 145 and back around sheave 144 until equilibrium is again achieved.

This constantly-seeking dynamically-equalizing process continues as traction apparatus 100 operates, always accommodating varying forces and keeping the system balanced. It supercedes and replaces such past practices as the use of right-lay (twist) cable paired with left-lay cable, massive spring systems, differential drives on driven pulleys (the two pulleys which constitute drive pulley pair 113 are solidly connected and drive together), and tedious adjustment of top-to-bottom cable length. In particular, it should be noted that it does not matter what the lay of any particular loop 126 is. Thus, for example, it is immaterial whether cable loops 126A and 126B have a right lay, a left lay, or opposite lays.

An attachment point 104 is provided at the base of upright member 134. This attachment point is not shown in FIG. 2 or 3 but is seen in detail in FIG. 7. When a load is applied to attachment point 104 as by a skier 105 being towed, a force opposite to the direction of travel (as shown by arrow 112 in FIG. 2) of traction apparatus 100 is produced. This force is resisted by small compensating cables 149 and 150 which divide the load between upper arm 151 and bottom arm 152 of cable loop 126A. This is accomplished by attaching one end of cable 149 to extension 141 of mounting block 135 by means of cable clamps 153 and 154. The other end of cable 149 is attached by cable clamping screw 165 to cable drum 155' near the base of upright member 133. In like fashion, one end of cable 150 is attached to extension 141' of mounting block 135' by means of cable clamps 153' and 154' while the other end is attached to cable drum 155 near the top of upright member 133. The result is the X connection from which panel assembly 127 derives its name. Cables 149 and 150 can be sized for half the strength of cables 126A and 126B in that they divide the load approximately by two and therefore are required to carry only half the total strain.

Figure 5:
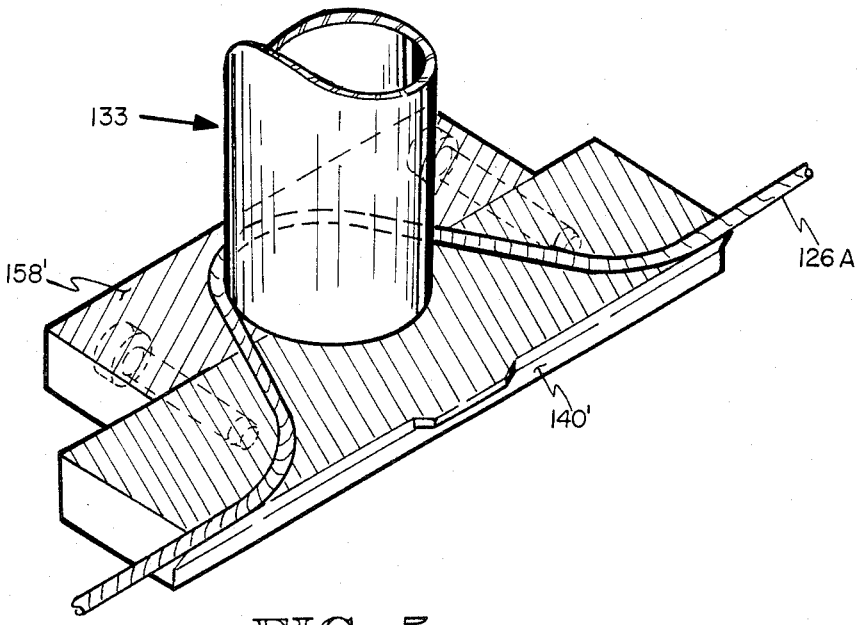
FIG. 5 is a cross sectional view of the cable clamp on the compensator unit of FIG. 4.

Upper portion 151 of cable loop 126A passes through groove 156 in clamp block 140 and is clamped thereto by clamp 158. similarly, bottom arm 152 of cable loop 126A passes through groove 156' in clamp block 140' and is clamped thereto by clamp 158' (not shown in FIG. 2); see FIG. 5. The points at which top cable arm 151 is clamped in block 140 and bottom cable arm 152 is clamped in block 140' are determined so as to assure that (a) upright member 133 is essentially parallel to upright member 134, and (b) cables 149 and 150 remain taut with spring-loaded drums 155 and 155' wound tight. The manner in which the cable clamping is achieved is shown in the cross sectional detail of FIG. 5.

Figure 6:
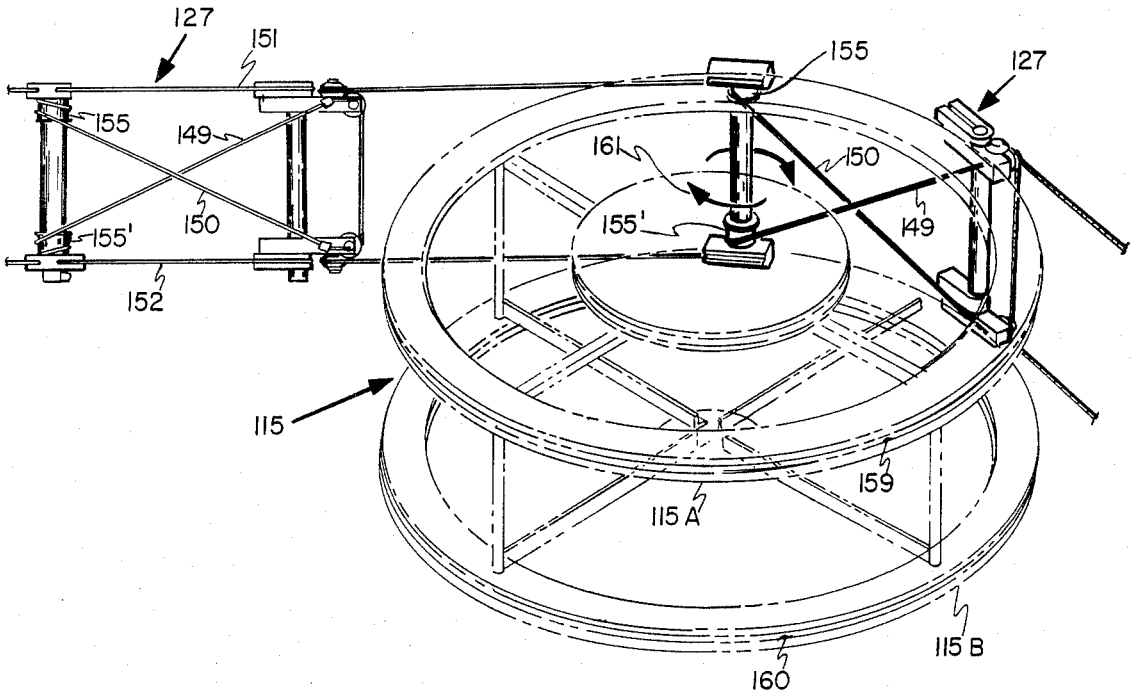
FIG. 6 is a detail of an X panel assembly passing around a pulley pair showing the action of the compensator unit of FIG. 4.

Spring-loaded drums 155 and 155' are provided in response to the following considerations. When cable loop 126A is traveling between pulley pairs, e.g., between idler pairs 114 and 115, top arm 151 and bottom arm 152 are tensioned equally as are cables 149 and 150. But when X panel assembly 127 passes around the periphery of pulley pair 115, as shown in FIG. 6, the situation changes. Arms 151 and 152 of cable loop 126A continue to be held in tension and are supported in grooves 159 and 160 of pulleys 115A and 115B, respectively. This is not the case, however, for cables 149 and 150. There is a geometric difference between the circumferential length of pulleys 115A and 115B engaged by cable arms 151 and 152, respectively, and the chordal distance across that length. In the absence of some structure for compensating for this fact, cables 149 and 150 would sag due to their apparent lengthening each time X panel assembly 127 runs around a pulley pair in its continued transit of circuit 102. As a result there would be a risk of fouling cables 149 and 150 each time X panel assembly 127 passes a pulley pair.

Such sagging is effectively precluded by the tension maintained on cables 149 and 150 by spring-loaded drums 155 and 155', respectively. That is to say, as shown by the rotational arrows 161 in FIG. 6, drums 155 and 155' rotate clockwise to take up the slack in cables 149 and 150 as X panel assembly 127 moves onto and traverses one half way around pulley pair 115 and counterclockwise to permit cables 149 and 150 to return to their fully extended positions as assembly 127 moves off pulley pair 115 and returns to straight line movement. It will be apparent that the only time drums 155, 155' actually rotate to any degree is when panel assembly 127 is traversing a pulley pair. Lips 171, 171' are provided on drums 155, 155', respectively, to preclude cables 149 and 150 from working their way off the drums and onto sleeve 163 during the rotational movement of the drums.

Figure 4:
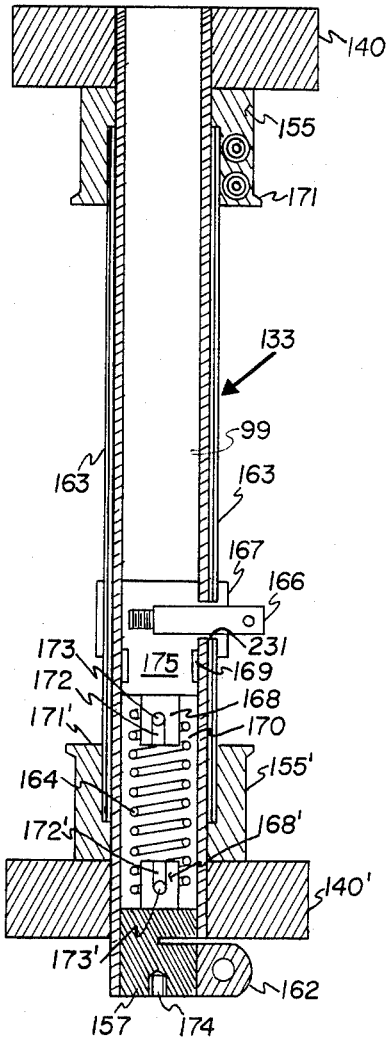
FIG. 4 is a cross sectional view through tubular upright member 133 which serves as the compensator unit of the X panel assembly of FIG. 2.

The manner in which spring-loaded drums 155, 155' operate is shown in FIG. 4. Drums 155, 155' are mounted at opposite ends of sleeve 163 on tube 99 to form a single unit acted upon by torsion spring unit 170. As can be seen in FIG. 4, upright member 133 is formed by tube 99 and sleeve 163. Spring unit 170 consists of spring 164 and solid cylinders 168, 168' having slots 172, 172' which hold the ends 173, 173' of spring 164. Solid cylinder 168' is mounted on spring tension element 157 (which is also a solid cylinder) held in place in tube 99 by clamp 162. A desired tension is placed on spring 164 as required, using for example an Allen wrench inserted in hexagonal recess 174, and then retightening clamp 162.

Solid cylinder 168 is mounted rigidly to larger solid cylinder 175 having stop pin 166 inserted therein through circumferential slot 231 in tube 99. Solid cylinder 175 is rotatably disposed in tube 99 such that pin 166 may rotate in slot 231 under the action of spring unit 170. The outer portion of pin 166 is fixedly mounted to outer sleeve 167 which in turn is fixedly mounted to sleeve 163. As a result, solid cylinders 168 and 175, pin 166, sleeves 163 and 167, and drums 155, 155' form a single integral unit rotatable with respect to tube 99 under the action of spring unit 170.

The tension placed on this single integral rotatable unit by crossing cables 149 and 150 is thus counterbalanced by the opposing tension placed thereon by spring unit 170. It is readily apparent that any slackness in crossing cables 149 and 150 is easily compensated for by an appropriate couner-rotation of drums 155, 155'.

As has been indicated earlier, an important function of X panel assembly 127 is to serve as the mounting place for attachment points 104 for the mechanism by which individual towing apparatus (tow ropes) 106 are pulled or towed by traction apparatus 100. The apparatus used and the manner in which this is accomplished will now be described in detail. An attachment point 104 is located at the lower end of tubular upright member 134 of X panel assembly 127 and is the point at which hook mechanism 176 (shown in detail in FIGS. 7–9) is mounted to X panel assembly 127. This is accomplished by means of carrier plate 183 from which depend spaced, vertical support members 198 and 200. Hook mechanism 176 is pivotally mounted on large pin 193 extending between support members 198 and 200.

The purpose of hook mechanism 176 is to pick up a ring 250 on a tow rope 106 (not shown in FIGS. 7–9) at the commencement of a tow, retain ring 250 firmly in place during the entire tow, and disengage from and drop ring 250 when the tow is completed. Upon disengaging from one tow, hook mechanism 176 has the capability of being placed in a mode whereby it can engage and pick up a new tow immediately.

Figure 7:
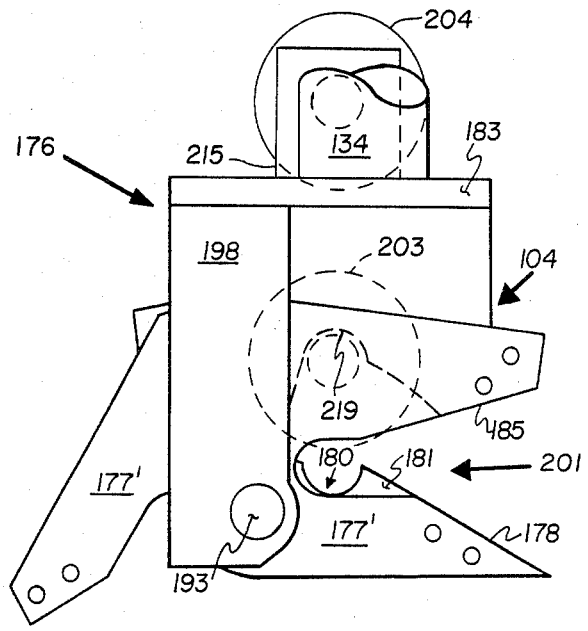
FIG. 7 is a side plan view of a coupling or clamping device, referred to as a hook mechanism in the detailed description of the specification, for attaching and releasing tow ropes to the traction means of the water skiing tow system.
Figure 9:
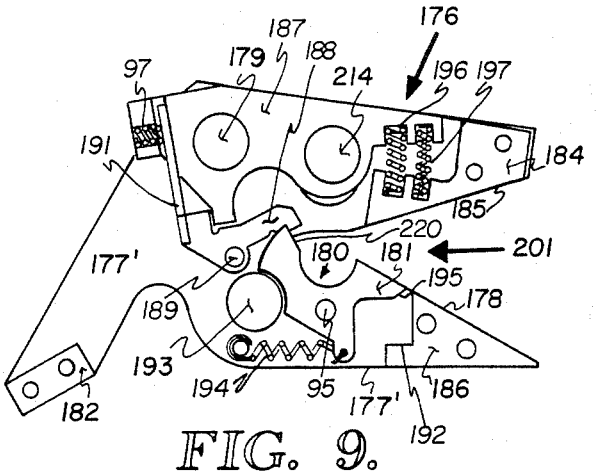
FIG. 9 is a cross sectional view through generally section 9—9 of FIG. 8.
Figure 10:
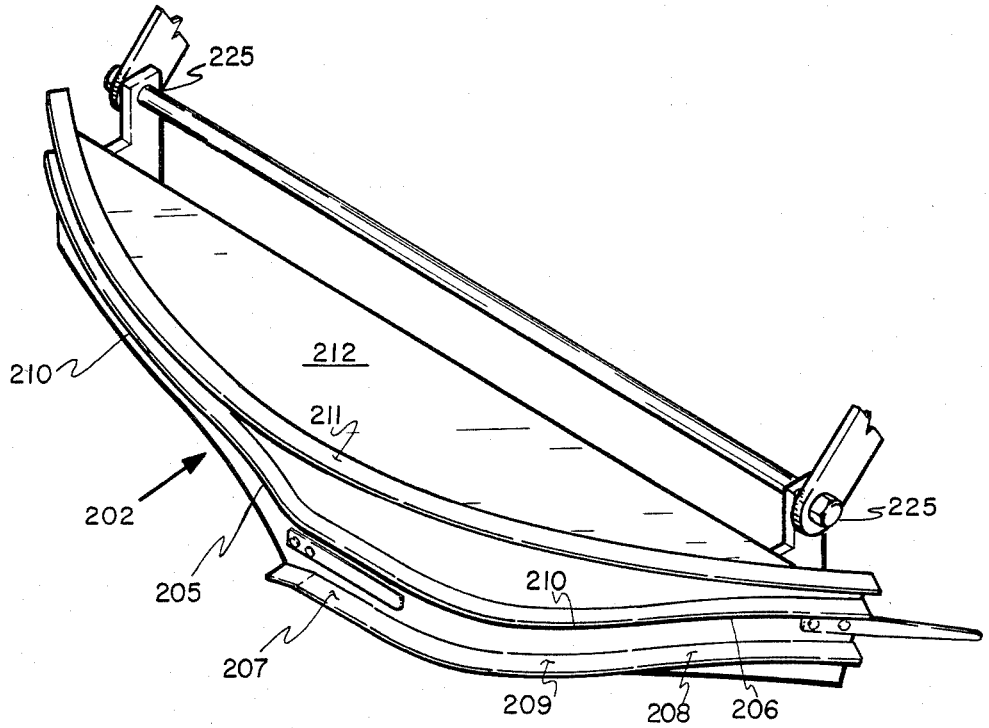
FIG. 10 is an isometric view of a camming mechanism used to open and close the hook mechanism of FIGS. 7-9.

Side plates 177, 177' separated by spacers 182, 184, and 186 define the outline of jaws 178 and 185 which form the mouth 201 by which ring 250 is guided into engagement with hook mechanism 176. As shown in FIGS. 7 and 9, hook mechanism 176 is in the closed and locked position whereby ring 250 is held in firm engagement in the semicircular recess 180 in latch 181. It will be understood that jaws 185 and 178 are not movable with respect to each other but are in permanent fixed relationship. Rather, ring 250 is locked in place in hook mechanism 176 by the counterclockwise movement (as shown in FIGS. 7 and 9) of latch 181 about pin 95. Disengagement and dropping of a ring 250 is accomplished by the reverse movement of latch 181 accompanied by the clockwise rotation of hook mechanism 176 about pin 193 to turn mouth 201 downward.

Figure 8:
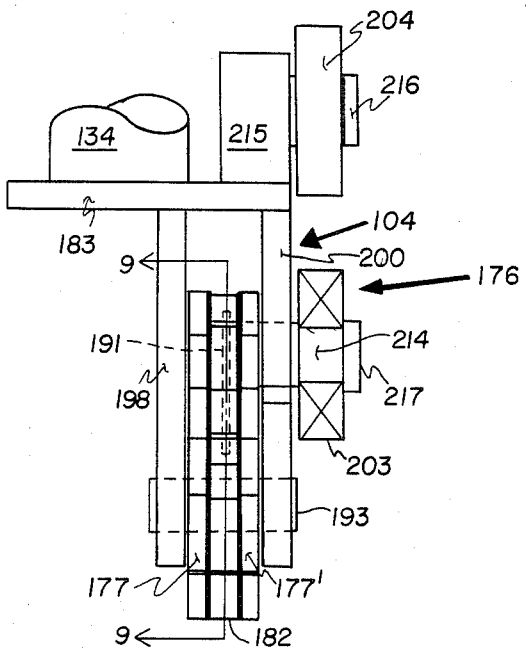
FIG. 8 is an end view of the device of FIG. 7 showing mounting of roller bearings 203 and 204 used with the camming mechanism of FIG. 10.

Roller bearing 203 when in contact with an appropriate guide surface moves in vertical relationship to roller bearing 204. As can be seen in FIG. 8, roller bearing 204 is mounted to carrier plate 183 by mounting unit 215 and held in place thereon by washer 216. Roller bearing 203 is mounted to hook mechanism 176 through pin 214 and held in place thereon by washer 217. As will be seen, the mode in which hook mechanism 176 is operating at any particular point in time is dependent on the vertically spaced relationship of roller bearings 203 and 204.

Latch 181 retains a ring 250 until hook mechanism 176 is actuated by coming into engagement with camramp 202 on circuit 102. Camramp 202 which is shown in detail in FIG. 10 guides roller bearing 203 through a series of constant acceleration-deceleration curves 205, 206, 207, and 208 on roller guides 209 and 210, thereby providing a uniform velocity up and down movement of roller 203 during its passage through camramp 202. Roller guides 209 and 210 are mounted in a desired spaced relationship on curved support structure 212 to produce the requisite camming action on roller 203. As hook mechanism 176 passes through camramp 202 from left to right, upper roller 204 bears along the top of ramp 211 which is also mounted on support structure 212 and which provides the necessary reference surface. Roller 203 initially engages the left end of curve 205 in roller guide 210 which forces it to move downward in relation to roller 204. As roller 203 and its attendant hook mechanism 176 continues its passage along camramp 202 it reaches the downward limit of its travel where it then engages roller guide 209 at curve 207 which begins lifting it back up. The upward lift is completed as roller 203 moves through curve 208 and regains its original spaced relationship with roller 204. Curve 206 on upper roller guide 210 serves to contain roller 203 in a narrow confine while maintaining the path of uniform acceleration-deceleration. Uniform acceleration-deceleration is an important factor at high actuating velocity to minimize shock applied to hook mechanism 176 as it passes through camramp 202.

When unloading and loading, the sequence of operation with regard to hook mechanism 176 is as follows. Roller 203 engages roller guide 210 on camramp 202. As it moves along curve 205, it forces downward bellcrank 187 which is fixedly mounted to it through pin 214. The downward movement of bellcrank 187 causes it to rotate about pin 179 which in turn forces latchpawl 188 to rotate about pin 189. The rotation of latchpawl 188 releases latch 181 which as a consequence of the action of spring 194 rotates about pin 95, thereby releasing its hold on ring 250. The rotation of latch 181 is stopped when lip 195 contacts step 192 on spacer 186.

The continued downward movement of roller 203 as it passes along curve 205 of roller guide 210 causes bellcrank 187 to disengage retainer 219 which is merely a sear portion of upright 200. This disengagement allows clockwise rotation of hook mechanism 176 until mouth 201 is facing substantially down, thereby spilling ring 250.

As roller 203 engages roller guide 209 on camramp 202, it is forced upward, thereby initiating a reversal of the sequence. Bellcrank 187 re-engages retainer 219, which returns hook mechanism 176 to a mouth-forward attitude. Compression springs 196 and 197 urge bellcrank 187 into retainer 219, and hold it there until the next activation sequence. Spring 194 continues to hold semicircular recess 180 on latch 181 in a "mouth-open" attitude until the inertial force of receiving a ring 250 being loaded rotates latch 181 counterclockwise, causing latchpawl 188 to ride up sear surface 220 and lock latch 181 in the closed position. Latchpawl 188 is held in contact with sear surface 220 by the action of flexure spring 191 held in place by set screw 97.

It will be apparent that each time rollers 203 and 204 engage camramp 202 an unloading sequence will occur. To avoid an automatic unload when a skier 105 has paid for more than one pass around circuit 102, camramp 202 is pivotally mounted about hinge point 225 so that it may readily be retracted out of the path of hook mechanism 176 as desired.

Figure 11:
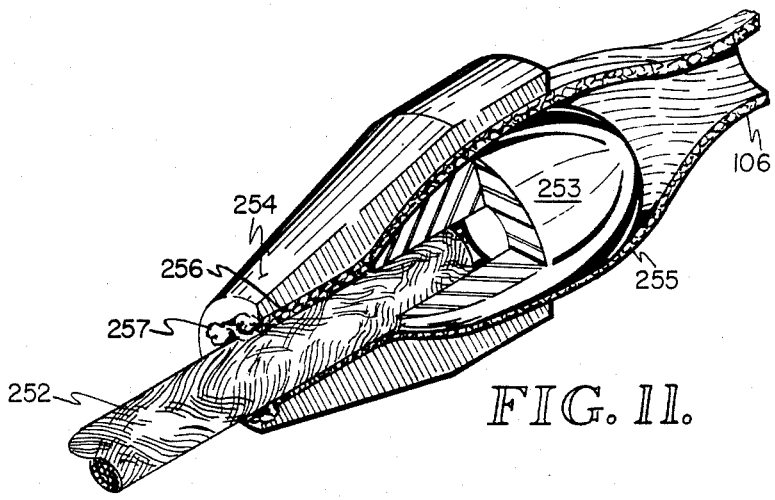
FIG. 11 is a cutaway perspective view of the ferrule assembly by which the tow rope is attached to the tow ring in an embodiment of the water skiing tow sysem of the invention.
Figure 12:
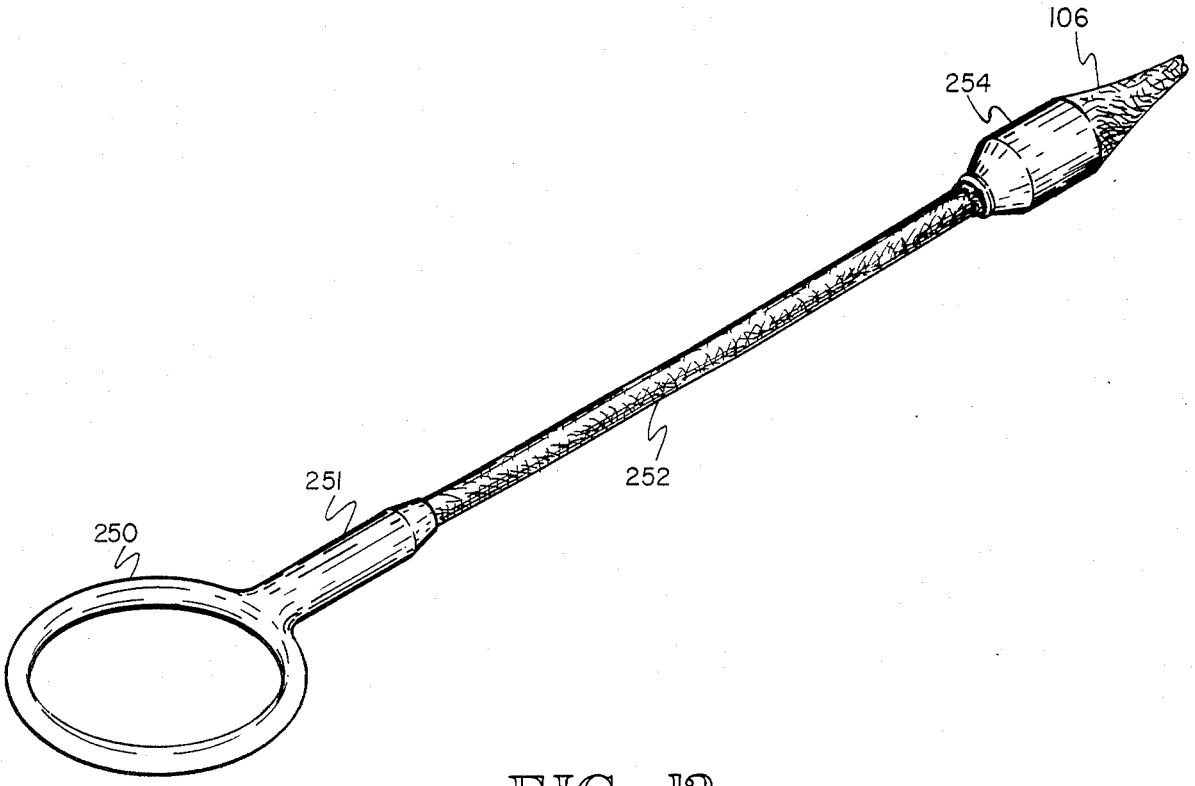
FIG. 12 shows a perspective view of the tow ring as attached to the tow rope in an embodiment of the water skiing tow system of the invention.

The manner in which ring 250 is connected to tow rope 106 is shown in FIGS. 11 and 12. Ring 250 has a tang 251 protruding normal to its diameter with a short length of ⅛inch aircraft cable 252 swaged into the tang 251. The other end of cable 252 terminates in a teardrop shape 253 swaged onto it. Ferrule 254 encircles cable 252 ahead of teardrop 253. The end of a braided plastic, e.g., Nylon or polypropylene, tow rope 106 is expanded 255 to envelop teardrop 253 and then contracted 256 around cable 252. Ferrule 254 is then slid over the contracted portion 256 of rope 106, effectively trapping and holding the braided rope on teardrop 253. Finally, the frayed end of rope 106 is then melted 257 to retain ferrule 254 in place.

The foregoing description of preferred embodiments of the invention has been presented for purposes of illustration and description. It is not intended to be exhaustive or to limit the invention to the precise form disclosed, and obviously many modifications and variations are possible in light of the above teaching. These embodiments were chosen and described in order to best explain the principles of the invention and its practical application to thereby enable others skilled in the art to best utilize the invention in various embodiments and with various modifications as are suited to the particular use of the invention as set forth herein. This description sets forth the best mode presently contemplated for the practice of the invention. Finally, it is intended that the scope of the invention be defined by the claims appended hereto.

What is claimed is:

1. Traction apparatus useful in a system for towing water skiers which comprises:

(a) a plurality of cables, each of which is formed into a single, open-ended loop, and (b) a plurality of means for connecting the cable loops end to end to produce an endless, closed sequence of said loops, said means for connecting said cable loops end to end comprising means for holding the open end of a first cable loop in fixed spaced relationship to the base of the next adjoining loop and including means for holding the ends of said first cable loop in fixed parallel relationship and sheave means permitting the base of said adjoining loop to move therethrough to equalize the length of cable in the arms of this loop, said sheave means being adapted to ensure that the arms of said loop engaged therewith are in the same spaced relationship as the ends of said first cable loop, said means for holding the ends of said first cable loop in fixed parallel relationship including first and second spacer means extending between the arms of said first cable loop and cable clamping means on each end of said spacer means secured to a corresponding arm of said first cable loop, said first and second spacer means having a pair of crossed compensating cables connected between them with the means for connecting said crossed compensating cables to said first spacer means being rotatable about the axis of said first spacer means and maintained under sufficient tension to ensure that said compensating cable remain taut regardless of the spacing between said first and second spacing means.

2. The traction apparatus of claim 1 wherein said sheave means is mounted to said second spacer means.

3. The traction apparatus of claim 2 wherein said second spacer means has engagement means for engaging pickup means on a tow line.

4. The traction apparatus of claim 3 wherein said pickup means on a tow line comprises a ring having a tang attached to said tow line and said engagement means is adapted to engage said ring.

5. The traction means of claim 4 wherein said engagement apparatus comprises:

(a) rotatably mounted guide jaws held in fixed open relationship for receiving a tow ring to be engaged, (b) latching means disposed in said jaws for engaging and holding a tow ring contacted therewith, and (c) means for causing said latch means to engage or release said tow ring.

6. A system for towing water skiers which comprises:

(a) sets of drive and idler pulley pairs, (b) means for supporting said sets of drive and idler pulley pairs at a desired elevation and in a desired spaced relationship corresponding generally to an intended towing path, (c) traction apparatus comprising a plurality of open-ended cable loops and a plurality of means for connecting said cable loops end to end to produce an endless, closed sequence in which the arms of each loop are substantially parallel and trained over the pulleys of each pulley pair, said means for connecting said cable loops end to end comprising means for holding the open end of a first cable loop in fixed spaced relationship to the base of the next adjoining loop including means for holding the ends of said first cable loop in fixed parallel relationship and sheave means permitting the base of said adjoining loop to move therethrough to equalize the length of cable in the arms of this loop, said sheave means being adapted to ensure that the arms of said loop engaged therewith are in the same spaced relationship as the ends of the said first cable loop, said means for holding the ends of said first cable loop in fixed parallel relationship including first and second spacer means extending between the arms of said first cable loop and cable clamping means on each end of said first spacer means secured to a corresponding arm of said first cable loop, said first and second spacer means having a pair of crossed compensating cables connected between them with the means for connecting said crossed compensating cables to said first spacer means being rotatable about the axis of said first spacer means and maintained under sufficient tension to ensure that said compensating cables remain taut regardless of the distance between said first and second spacing means, (d) means for driving said traction apparatus at a desired speed, (e) a plurality of tow lines, and (f) means for coupling and releasing said tow lines to and from said traction apparatus.

7. The towing system of claim 6 wherein said sheave means is mounted to said second spacer means.

8. The towing system of claim 7 wherein said means for coupling and releasing said tow lines to and from said traction apparatus is mounted to said second spacer means.

9. The towing system of claim 8 having camming means rotatably disposed to engage said means for coupling and releasing said tow lines at predetermined intervals to cause said coupling means to release said tow lines.

* * * * *